US007611138B2

(12) United States Patent
Fujita et al.

(10) Patent No.: US 7,611,138 B2
(45) Date of Patent: Nov. 3, 2009

(54) PAPER FEEDER AND IMAGE FORMING APPARATUS USING THE SAME

(75) Inventors: Akihiro Fujita, Kanagawa (JP); Manabu Nonaka, Kanagawa (JP); Hajime Nishida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 477 days.

(21) Appl. No.: 11/113,115

(22) Filed: Apr. 22, 2005

(65) Prior Publication Data

US 2005/0253323 A1 Nov. 17, 2005

(30) Foreign Application Priority Data

May 11, 2004 (JP) ..... 2004-140979

(51) Int. Cl.
*B65H 5/26* (2006.01)

(52) U.S. Cl. ..... 271/9.09; 271/9.01

(58) Field of Classification Search ..... 271/9.01, 271/9.09, 162, 9.04, 9.08, 9.11, 9.13; 347/104
See application file for complete search history.

(56) References Cited

U.S. PATENT DOCUMENTS

| | | | | | |
|---|---|---|---|---|---|
| 4,545,668 | A | * | 10/1985 | Zaitsu | 399/125 |
| 4,925,062 | A | * | 5/1990 | Tsukamoto et al. | 271/115 |
| 5,049,918 | A | * | 9/1991 | Hisada et al. | 355/403 |
| 5,213,427 | A | * | 5/1993 | Grosse et al. | 400/680 |
| 5,359,435 | A | * | 10/1994 | Hayashi et al. | 358/498 |
| 5,999,772 | A | * | 12/1999 | Kakitani et al. | 399/125 |
| 6,328,394 | B1 | * | 12/2001 | Shirai et al. | 347/2 |
| 6,942,211 | B2 | * | 9/2005 | Teo et al. | 274/145 |
| 7,052,197 | B2 | * | 5/2006 | Bowen et al. | 400/624 |
| 2003/0052956 | A1 | * | 3/2003 | Katsuyama | 347/108 |
| 2005/0006835 | A1 | * | 1/2005 | Teo et al. | 271/9.01 |

FOREIGN PATENT DOCUMENTS

| | | | |
|---|---|---|---|
| JP | 4-12425 | | 1/1992 |
| JP | 4-149568 | | 5/1992 |
| JP | 8-143189 | * | 6/1996 |
| JP | 11-180614 | * | 7/1999 |
| JP | 2002-229286 | * | 8/2002 |
| JP | 2003-173125 | | 6/2003 |
| JP | 2003-192205 | * | 7/2003 |

OTHER PUBLICATIONS

Jun. 30, 2008 Japanese official action in connection with corresponding Japanese application No. 2004-140979.

* cited by examiner

*Primary Examiner*—Patrick H Mackey
*Assistant Examiner*—Thomas A Morrison
(74) *Attorney, Agent, or Firm*—Cooper & Dunham, LLP

(57) ABSTRACT

A paper feeder for feeding paper in an image forming apparatus is disclosed. The paper feeder includes multiple manual paper feed openings and multiple manual paper feed parts positioned corresponding to the manual paper feed openings. The manual paper feed openings and the manual paper feed parts are provided in the main body of the paper feeder.

16 Claims, 3 Drawing Sheets

PAPER FEEDER AND IMAGE FORMING APPARATUS USING THE SAME

BACKGROUND

1. Technical Field

This disclosure relates generally to paper feeders and more particularly to a paper feeder used for manual paper feed in image forming apparatuses such as copiers, printers, and facsimile machines.

2. Description of the Related Art

Some image forming apparatuses such as copiers have an automatic paper feed unit and a manual paper feed unit including a manual paper feed tray provided to a manual paper feed opening. In the automatic paper feed unit, a stack of paper sheets is set in one or multiple paper feed cassettes disposed in the main body of the image forming apparatus (the apparatus main body), and the uppermost one of the paper sheets is fed out based on a command. The manual paper feed unit is used to form an image on a paper sheet of a type or size that is not set in the paper feed cassettes of the automatic paper feed unit.

Some conventional image forming apparatuses employ a manual feed tray screwed to a side of the apparatus main body as a manual paper feed unit. Meanwhile, a retractable manual feed tray attached rotatably to the apparatus main body so as to be openable and closable in consideration of space savings and appearance is also employed in many conventional image forming apparatuses.

This retractable manual feed tray stands against a side of the apparatus main body when retracted (closed). In this state, no paper is feedable. However, this does not pose a problem in many cases. This is because the manual feed tray is used to feed paper mostly when specialty paper such as postcards, OHP sheets, and sticker sheets is used, and such specialty paper is used less frequently than plain paper except for some users and it is often the case that only a single copy is made.

Further, for instance, Japanese Laid-Open Utility Model Application No. 4-12425 discloses a paper feed unit into which a paper feed cassette and a manual feed unit are integrated. The paper feed cassette is capable of carrying (containing) a stack of paper sheets as the paper feed cassette of the automatic paper feed unit. The manual feed unit, to which paper sheets are fitted and fed manually one by one, is mounted integrally on the upper surface of the paper feed cassette. In principle, plain paper is contained in the cassette to be fed, and heavy paper is fed from the manual feed unit. However, the side fences of the manual feed unit project upward on the upper surface of the cassette, so that the paper feed unit cannot be retracted as a retractable manual feed tray.

BRIEF SUMMARY

In an aspect of this disclosure, there is provided a paper feeder that has a paper feed unit for heavy paper and a manual paper feed unit that can receive and feed a stack of paper such as plain paper, and can be housed (retracted) in an image forming apparatus so as to stand against (be flush with) a side of the apparatus main body.

In addition, an image forming apparatus using the paper feeder can be provided.

A paper feeder for feeding paper in an image forming apparatus, in an exemplary embodiment, includes a plurality of manual paper feed openings, and a plurality of manual paper feed parts positioned corresponding to the manual paper feed openings, wherein the manual paper feed openings and the manual paper feed parts are provided in a main body of the paper feeder.

In another aspect of this disclosure, there is provided an image forming apparatus including a paper feeder, the paper feeder including: a plurality of manual paper feed openings; and a plurality of manual paper feed parts positioned correspondingly to the manual paper feed openings, wherein the manual paper feed openings and the manual paper feed parts are provided in a main body of the paper feeder.

In another aspect of this disclosure, a paper feeder enables both manual feeding of heavy paper and placement and feeding of a stack of paper such as plain paper. Further, the paper feeder may be retracted (housed) in the main body of an image forming apparatus so as to stand against (be flush with) a side thereof. This saves space and provides a good appearance.

BRIEF DESCRIPTION OF THE DRAWINGS

Other aspects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of an embodiment of the present invention.

Figure 1:
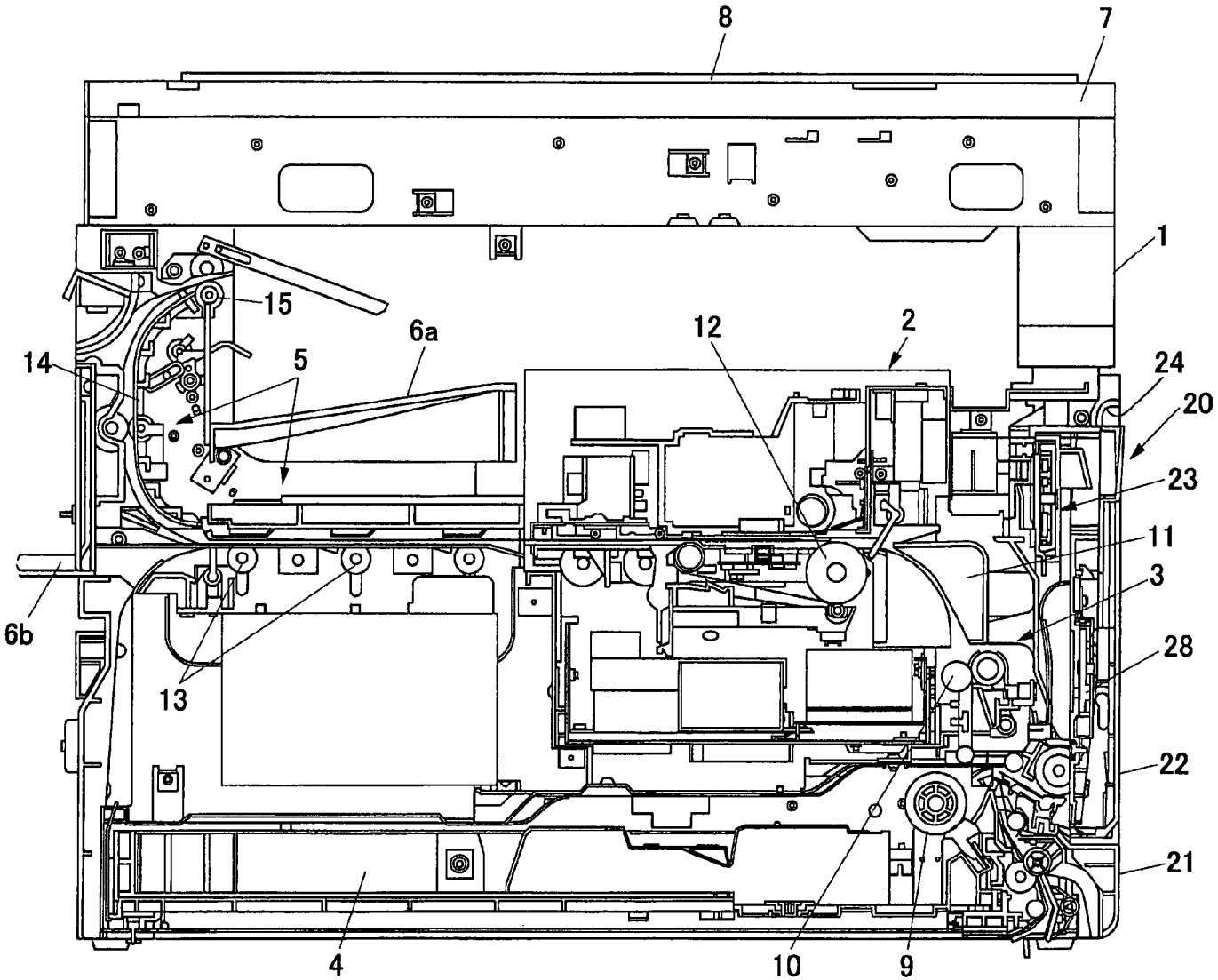
FIG. 1 is a schematic cross-sectional view of an image forming apparatus including a manual paper feeder according to an embodiment of the present invention.
Figure 2:
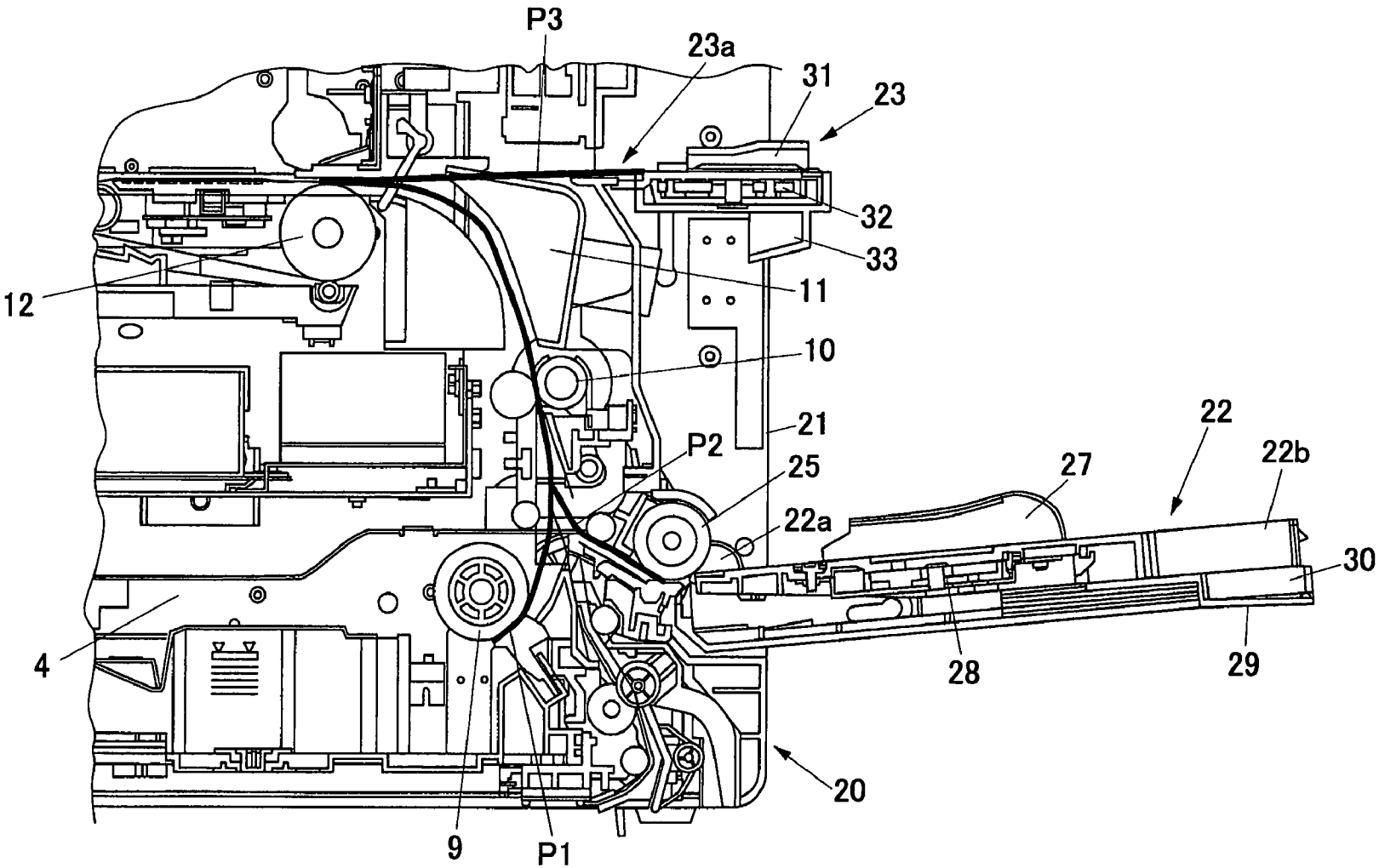
FIG. 2 is an enlarged cross-sectional view of the manual paper feeder and its vicinity according to the embodiment of the present invention.
Figure 3:
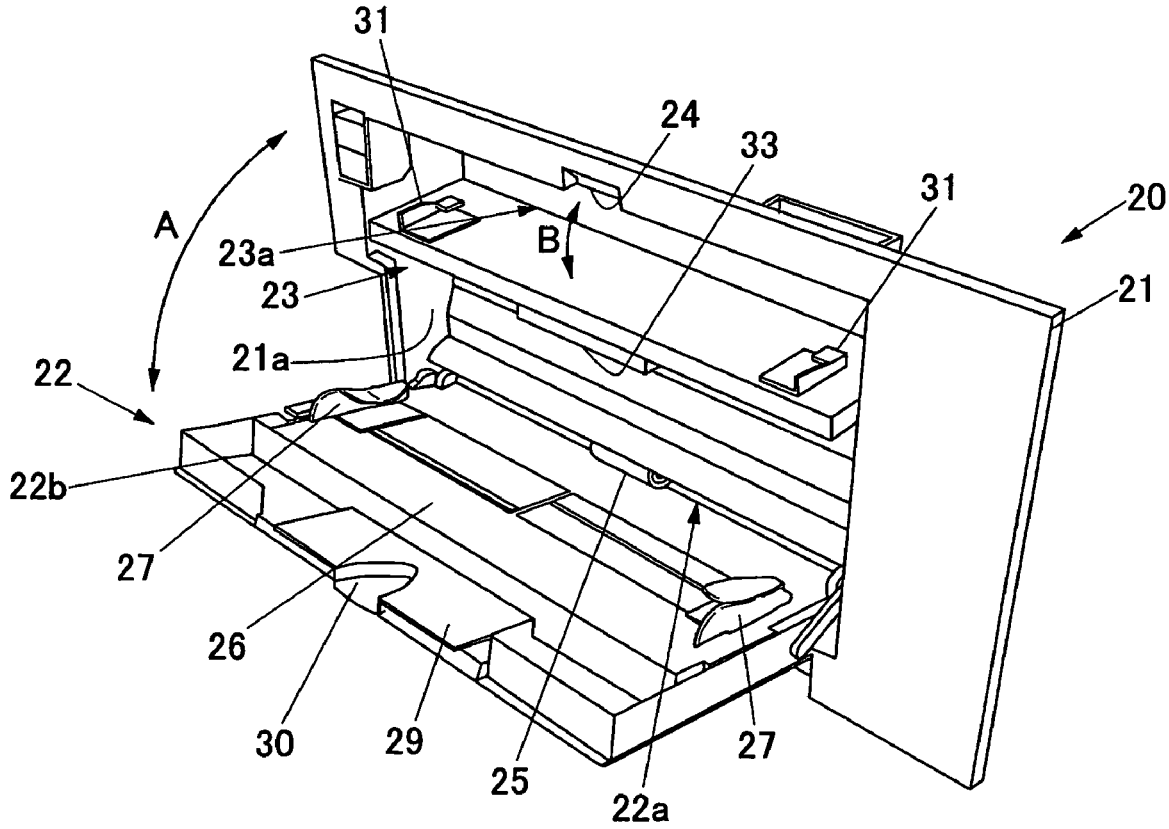
FIG. 3 is a perspective view of the manual paper feeder and a right door to which the manual paper feeder is provided according to the embodiment of the present invention.

FIG. 1 is a schematic cross-sectional view of an image forming apparatus (such as a copier, a printer, or a facsimile machine) including a manual paper feeder 20 according to the embodiment of the present invention. FIG. 2 is an enlarged cross-sectional view of the manual paper feeder 20 and its vicinity. FIG. 3 is a perspective view of the manual paper feeder 20 and a right door 21 to which the manual paper feeder 20 is provided. The image forming apparatus of this embodiment includes an image forming part 2 and a conveyance part 3 in an apparatus main body 1. Based on a command from a scanner or a control unit (not graphically illustrated), recording media such as paper sheets are fed one by one from the uppermost one from a main body paper feed unit 4 provided at the bottom of the apparatus main body 1. Each fed paper sheet is conveyed in a position opposite the image forming part 2 by the conveyance part 3. After a required image is formed (recorded) on the paper sheet by the image forming part 2, the paper sheet is output through an output paper conveyance part 5 onto a paper output part **6*a* formed on the upper surface of the apparatus main body 1 or a paper output tray 6*b* formed like a door. The paper output part 6*a* is for so-called "inner output," and the paper output tray 6*b*** is for so-called "straight output." The recording media are referred to by "paper sheets" in this embodiment, but are not limited to paper.

An image reading part (a scanner part) for image reading is provided above the paper output part **6*a* on the apparatus main body 1 as an input system for inputting the image data (printing data) of an image to be formed in the image forming part 2. In FIG. 1, however, only a frame material 7 for providing the scanner part is shown. The scanner part employs a conventional configuration in which: a first scanning optical system including an illumination light source and a mirror and a second scanning optical system including mirrors move to read the image of an original material such as a document placed on a contact glass; the image of the original material obtained by the scanning is read as an image signal by an image reading device; image processing is performed by digitizing the read image signal; and the image is formed on a paper sheet as described above based on printing data obtained by the image processing. Alternatively, the scanner part may employ another configuration. On the contact glass 8**, a pressure plate for pressing the original material and/or an automatic document feeder (ADF) may be provided.

The conveyance part 3 includes a pair of conveyance rollers 10, a conveyance direction guide part 11, and a press roller 12. The conveyance rollers 10 convey upward a paper sheet fed from the main body paper feed unit 4 by a pickup roller 9. The conveyance direction guide part 11 is disposed on the upstream side of the image forming part 2 in a direction in which the paper sheet is conveyed (a paper conveyance direction). The conveyance direction guide part 11 conveys the paper sheet fed from below while changing the paper conveyance direction by substantially 90°. The output paper conveyance part 5, which is on the downstream side of the image forming part 2 in the paper conveyance direction, includes multiple pairs of conveyance rollers 13 for conveying the paper sheet on which an image is formed, a paper output path 14, and a pair of paper output rollers 15 for outputting the paper sheet sent out through the paper output path 14 onto the paper output part 6*a*.

The manual paper feeder 20 is integrated with the right door 21 as its apparatus main body, the right door 21 covering the right side of the apparatus main body 1 in FIG. 1 so as to be openable and closable with respect thereto. The manual paper feeder 20 includes a first manual paper feed part 22 and a first paper feed opening 22*a* in its lower part. The first manual paper feed part 22, which can receive and feed a stack of paper such as plain paper, is a so-called multi-paper feeder. The manual paper feeder 20 has a second manual paper feed part 23 and a second paper feed opening 23*a* for feeding heavy paper disposed above the first manual paper feed part 22 and the first paper feed opening 22*a*. The first manual paper feed part 22 and the first paper feed opening 22*a* and the second manual paper feed part 23 and the second paper feed opening 23*a* are provided in a "double-entry door"-like manner at vertically different positions. That is, as illustrated in FIG. 1, when the second manual paper feed part 23 is closed and then the first manual paper feed part 22 is closed, the second manual paper feed part 23 positioned inside the first manual paper feed part 22 is not visible externally. Not only the second manual paper feed part 23 but also the second paper feed opening 23*a* and the first paper feed opening 22*a* are hidden inside the first manual paper feed part 22 by closing the first manual paper feed part 22. Although not related to opening and closing the first paper feed opening 22*a* and the second paper feed opening 23*a*, the right door 21 is also openable and closable. Accordingly, a "triple-entry door" structure is formed including the right door 21.

The right door 21 has its lower end supported by a shaft so as to rotate upward and downward as indicated by the double-headed arrow A in FIG. 3 with respect to the apparatus main body 1. A cutout 24 is provided to the upper edge of the right door 21 as a handle for rotational opening and closing operations. A recess 21*a*, a rectangular depression toward the inside of the apparatus main body 1, is formed inside the right door 21. The first manual paper feed part 22 and the second manual paper feed part 23 are provided in the recess 21*a*. Although not graphically illustrated or described in detail, guide members including part of the conveyance direction part 11 on one side, rollers, and switches for opening and closing detection are provided on the internal side, which is the apparatus main body 1 side. In this embodiment, the right door 21 is openable and closable. However, according to the present invention, the manual paper feeder 20 may be provided to a part of the apparatus main body 1 which is not openable or closable. For instance, the manual paper feeder 20 may be provided to a panel member of the apparatus main body 1. Further, in carrying out the present invention, the position at which the manual paper feeder 20 is provided is not limited to the right door 21 as illustrated, and the manual paper feeder 20 may also be provided to a left door or a front door of the apparatus main body 1.

Like the right door 21, the first manual paper feed part 22 has its shaft part (not graphically illustrated), provided on the outside of its bottommost part, supported by a shaft inside the recess 21*a* so as to be rotatable upward and downward as indicated by the double-headed arrow A in FIG. 3, thus being openable and closable. As illustrated in FIGS. 2 and 3, the first manual paper feed part 22 is opened and closed with the right door 21 being closed. If necessary, however, the first manual paper feed part 22 may be opened and closed even with the right door 21 being open. A pickup roller 25 for feeding paper from the first manual paper feed part 22 is supported rotatably by a shaft inside the opening of the right door 21.

A flat surface part 26 for receiving paper (on which paper is placed) is provided on a surface of the first manual paper feed part 22 which surface serves as an upper surface when the first manual paper feed part 22 is open. A pair of side fences 27 are provided on the flat surface part 26 so as to be movable in the directions of the width of paper to be fed (the paper width directions). A rack and pinion mechanism 28 for operating the side fences 27 is housed below the flat surface part 26 inside the first manual paper feed part 22. Further, a retractable paper support plate 29 is provided below the flat surface part 26, so that in the case of handling B4 landscape size or A3 size paper, an end part of the paper sticking out of the flat surface part 26 may be supported from its lower side. A recess 22*b* for avoiding interference with the second manual paper feed part 23 is formed outside the flat surface part 26 (on the end side as a door) in the first manual paper feed part 22. A recess 30 is provided in the center in the paper width directions on the upper surface of the paper support plate 29. The recess 30 makes it easy for a user to pull out the paper support plate 29 with a hand and handle paper on the pulled-out paper support plate 29. Further, the recess 30, which is provided in the position corresponding to the cutout 24 of the right door 21, is also employable as part of a handle for opening and closing the first manual paper feed part 22.

The second manual paper feed part 23 is provided on the upper end side in the recess 21*a* of the right door 21. The second manual paper feed part 23 has its shaft part (not graphically illustrated), provided on the outside of its bottommost part, supported by a shaft inside the recess 21*a* so as to be rotatable upward and downward as indicated by the double-headed arrow B in FIG. 3, thus being openable and closable as is the first manual paper feed part 22. As illustrated in FIGS. 2 and 3, the second manual paper feed part 23 is opened and closed with the right door 21 being closed and the first manual paper feed part 22 being open. If necessary, however, the second manual paper feed part 23 may be opened and closed even with the right door 21 being open.

The second manual paper feed part 23 includes a flat surface for paper setting (on which paper is set), which surface serves as an upper surface when the second manual paper feed part is open. A pair of side fences 31 are provided on the flat surface so as to be movable in the paper width directions. A rack and pinion mechanism 32 for operating the side fences 31 is housed below the flat surface inside the second manual paper feed part 23. A handle 33 for opening and closing operations is provided on a surface of the second manual paper feed part 23 on the opposite side from the flat surface for paper setting, which surface serves as an external surface when the second manual paper feed part 23 is closed. The second manual paper feed part 23 is provided for straight paper feed (feeding paper without bending it) as described below. Accordingly, unlike the first manual paper feed part 22, the second manual paper feed part 23 does not have a pickup roller.

Next, a description is given of a paper feed operation according to this embodiment. First, in the case of performing automatic paper feed, the openable (retractable) parts such as the openable part of the right door 21 are closed so that no warning is issued. Then, the image forming part 2 is put into operation. A paper sheet is fed (or paper sheets are fed one by one) from the main body paper feed unit 4 based on a command from a controller (not graphically illustrated), and a required image is formed (recorded) on the paper sheet by the image forming part 2. Thereafter, the paper sheet is output through the output paper conveyance part 5 onto the paper output part 6*a*, or is output onto the paper output tray 6*b* by the conveyance rollers 13. In this case, the paper sheet fed from the main body paper feed unit 4 by the pickup roller 9 is conveyed to the image forming part 2 through a vertical conveyance path P1 (FIG. 2) by the conveyance part 3.

Next, a description is given of a manual paper feed operation. First, in the case of using the first manual paper feed part 22, with the right door 21 being closed, a hand is put in the gap formed between the cutout 24, open laterally to the outside of the right door 21, and the recess 30, open to the upside of the paper support plate 29, so as to pull down and open the entire first manual paper feed part 22. Then, the distance between the side fences 27 is changed corresponding to paper size, and a required number of paper sheets suitable for image recording are placed on the flat surface part 26. It is often the case that one to one hundred sheets of paper, for instance, are placed on this type of paper feed unit. The maximum number of placeable sheets of paper may be determined by design. Then, the image forming part 2 is put into operation. One of the paper sheets is fed (or the paper sheets are fed one by one) from the first manual paper feed part 22 based on a command from the controller (not graphically illustrated), and a required image is formed (recorded) on the paper sheet by the image forming part 2. Thereafter, the paper sheet is output through the output paper conveyance part 5 onto the paper output part 6*a*, or is output onto the paper output tray 6*b* by the conveyance rollers 13. In this case, the paper sheet fed from the first manual paper feed part 22 by the pickup roller 25 at the first paper feed opening 22*a* is conveyed to the image forming part 2 through a vertical conveyance path P2 (FIG. 2) by the conveyance part 3.

Next, in the case of using the second manual paper feed part 23, with the right door 21 being closed, the entire first manual paper feed part 22 is pulled down to be open, and then the handle 31 is operated so as to pull down and open the entire second manual paper feed part 23. The distance between the side fences 31 is changed corresponding to paper size, and a single sheet of paper, for instance, heavy paper, is placed on the second manual paper feed part 23. At this point, while being kept horizontal, the paper sheet is pushed straight and deep inside the apparatus main body 1 from the second paper feed opening 23*a* so as to pass over the conveyance direction guide part 11 to have its leading edge reaching the nip of the press roller 12. Then, the image forming part 2 is put into operation. The paper sheet is fed from the second manual paper feed part 23 based on a command from the controller (not graphically illustrated), and a required image is formed (recorded) on the paper sheet by the image forming part 2. Thereafter, the paper sheet is output through the output paper conveyance part 5 onto the paper output part 6*a*, or is output onto the paper output tray 6*b* by the conveyance rollers 13. In this case, the paper sheet fed from the second manual paper feed part 23 is conveyed to the image forming part 2 through a lateral conveyance path P3 (FIG. 2) by the conveyance part 3. That is, the second manual paper feed part 23 and the second paper feed opening 23*a* forms a so-called "straight path." Further, in the case of using heavy paper as a paper sheet, if the paper sheet is output onto the paper output tray 6*b*, the entire conveyance path between paper feed and paper output is a straight path.

If a paper jam occurs in, for instance, the conveyance part 3 in paper feeding as described above, the right door 21 may be opened so that a paper removal operation is performable. In this case, with the right door 21 being closed, a hand is put in the gap formed between the cutout 24, open laterally to the outside of the right door 21, and the recess 30, open to the upside of the paper support plate 29. Then, the hand is put on the right door 21 inside the cutout 24 so as to pull down and open the entire right door 21.

The present invention is not limited to the specifically disclosed embodiment, and variations and modifications may be made without departing from the scope of the present invention.

The present application is based on Japanese Priority Patent Application No. 2004-140979, filed on May 11, 2004, the entire contents of which are hereby incorporated by reference.

What is claimed is:

1. An image forming apparatus, comprising:

a side door member configured to cover a side of a main body of the image forming apparatus, the side door member being openable and closable with respect to the main body;

an image forming part provided in the main body and configured to form an image on paper; and a paper feeder integrated with the side door member, the paper feeder including a plurality of paper feed openings; and a plurality of paper feed parts provided in positions corresponding to the paper feed openings, the paper feed parts including a first paper feed part configured to receive a plurality of paper sheets and feed the paper sheets and a single sheet manual feed part configured to feed a single paper sheet and provided above the first paper feed part, wherein the single sheet manual feed part has a straight conveyance path conveying the paper sheet horizontally and straight without bending the paper sheet from the single sheet manual feed part up to the image forming part, the first paper feed part has a first door member having a tray for holding the paper sheets, the first door member being provided so as to be rotatable and to be openable and closable with respect to the main body of the image forming apparatus, the single sheet manual feed part has a second door member having a tray for holding the paper sheet, the second door member being provided inside the first door member so as to be rotatable and to be openable and closable with respect to the main body of the image forming apparatus so as to be covered by the first door member, a paper conveyance path from the first paper feed part to the image forming part conveys the paper sheets from the first paper feed part in an upward direction, and merges with the straight conveyance path of the single sheet manual feed part on an upstream side of the image forming part, the second door member of the single sheet manual feed part and the paper feed openings are configured to be hidden inside the first door member of the first paper feed part and externally invisible with the first door member and the second door member being closed, the side door member has a guide member provided on an internal side thereof, the guide member being configured to guide the paper sheets conveyed from the first paper feed part in the upward direction, and the side door member, the first door member, and the second door member form a triple door structure, the first door member configured to be opened with the side door member being closed.

2. The image forming apparatus as claimed in claim 1, wherein:

the first paper feed part covers a first one of the paper feed openings corresponding thereto, the single sheet manual feed part, and a second one of the paper feed openings corresponding to the single sheet manual feed part.

3. The image forming apparatus as claimed in claim 2, wherein:

the first paper feed part has the first door member supported rotatably so as to be openable and closable on a lower side in the main body of the paper feeder; and the single sheet manual feed part has the second door member supported rotatably so as to be openable and closable on an upper side in the main body of the paper feeder.

4. The image forming apparatus as claimed in claim 3, wherein the first paper feed part externally covers the single sheet manual feed part with the first paper feed part and the single sheet manual feed part being closed by upward rotation.

5. The image forming apparatus as claimed in claim 2, wherein:

a recess is provided in the main body of the paper feeder so as to be open outward;

the first paper feed part has the first door member supported rotatably so as to be openable and closable in a lower part of the recess;

the single sheet manual feed part has the second door member supported rotatably so as to be openable and closable in an upper part of the recess; and the first paper feed part externally covers the single sheet manual feed part with the first paper feed part and the single sheet manual feed part being closed by upward rotation.

6. The image forming apparatus as claimed in claim 2, wherein the straight conveyance path of the single sheet manual feed part includes the second one of the paper feed openings corresponding thereto.

7. The image forming apparatus as claimed in claim 2, wherein each of the first paper feed part and the single sheet manual feed part includes a handle.

8. The image forming apparatus as claimed in claim 7, wherein:

the handle of the first paper feed part is provided at an upper end thereof so as to be open upward with the first paper feed part being closed; and the handle of the single sheet manual feed part is provided on an external surface thereof so as to project therefrom with the single sheet manual feed part being closed.

9. The image forming apparatus as claimed in claim 8, wherein the paper feeder includes a handle in the main body thereof.

10. The image forming apparatus as claimed in claim 9, wherein the handle of the main body of the paper feeder and the handle of the first paper feed part are provided so as to be positioned in correspondence to each other with the first paper feed part being closed.

11. The image forming apparatus as claimed in claim 8, wherein the handle of the first paper feed part is provided to a member provided to be retractable with respect to the first paper feed part.

12. The image forming apparatus as claimed in claim 1, further comprising:

an automatic paper feeder in a part of the main body of the image forming apparatus other than the paper feeder.

13. The image forming apparatus as claimed in claim 12, wherein:

the straight conveyance path of the single sheet manual feed part is positioned above a paper conveyance path from the automatic paper feeder.

14. The image forming apparatus as claimed in claim 13, wherein a paper feed member of the automatic paper feeder and a paper feed member of the first paper feed part are disposed so as to change a direction in which the paper is conveyed in one of the paper conveyance path from the automatic paper feeder and a paper conveyance path from the first paper feed part, and merge the paper conveyance paths from the automatic paper feeder and the first paper feed part with the straight conveyance path from the single sheet manual feed part on an upstream side of an image recording part in the direction in which the paper is conveyed.

15. The image forming apparatus as claimed in claim 1, further comprising:

an image reading part.

16. The image forming apparatus as claimed in claim 15, wherein the main body of the image forming apparatus includes a paper output part below the image reading part.

* * * * *